US008177153B2

(12) United States Patent
Leitch

(10) Patent No.: US 8,177,153 B2
(45) Date of Patent: May 15, 2012

(54) SIDE RAIL FOR A SHREDDER WITH EMBEDDED FINGERS

(75) Inventor: James A. Leitch, Cambridge (CA)

(73) Assignee: Shred-Tech Corporation, Cambridge, Ontario (CA)

( * ) Notice: Subject to any disclaimer, the term of this patent is extended or adjusted under 35 U.S.C. 154(b) by 597 days.

(21) Appl. No.: 12/368,291

(22) Filed: Feb. 9, 2009

(65) Prior Publication Data

US 2009/0199933 A1 Aug. 13, 2009

Related U.S. Application Data

(60) Provisional application No. 61/027,455, filed on Feb. 9, 2008.

(51) Int. Cl.
*B02C 18/16* (2006.01)

(52) U.S. Cl. ..... 241/285.1; 241/236

(58) Field of Classification Search ..... 241/236, 241/243, 285.1, 285.2, 285.3
See application file for complete search history.

(56) References Cited

U.S. PATENT DOCUMENTS

| | | | | |
|---|---|---|---|---|
| 4,691,871 | A * | 9/1987 | Mochizuki | 241/166 |
| 5,855,700 | A * | 1/1999 | Guerard | 148/522 |
| 2006/0049291 | A1 * | 3/2006 | Rajewski | 241/167 |

* cited by examiner

*Primary Examiner* — Mark Rosenbaum
(74) *Attorney, Agent, or Firm* — Daryl W. Schnurr

(57) ABSTRACT

A side rail for installation in a shredder and method of fabrication in which the side rail has fingers that are partially embedded in a base. The fingers are made from steel and the base is made from cast aluminum. The fingers have a dovetail shape at an outer end thereof that is immersed in molten aluminum in a mold. When the aluminum is allowed to harden the fingers are embedded in the base. The side rails are much lighter weight than previous side rails, and are still sufficiently strong to be used in a mobile shredder.

16 Claims, 10 Drawing Sheets

SIDE RAIL FOR A SHREDDER WITH EMBEDDED FINGERS

Applicant claims the benefit of U.S. Provisional Application Ser. No. 61/027,455 filed on Feb. 9, 2008

BACKGROUND OF THE INVENTION

1. Field of the Invention

This invention relates to a side rail for a shredder, the side rail having fingers embedded therein, the fingers being spaced apart from one another and being parallel to one another.

2. Description of the Prior Art

Side rails for shredders are known, and it is known to have fingers welded to the side rails, the fingers extending inward from the side rails. The fingers are spaced apart from one another and are parallel to one another, and extend between the knives of the shredders. The purpose of the fingers is to remove paper from the sides of the shredder knives and also to prevent paper that has not been shredded from falling between the shredder knives in the area where the fingers are located.

It is also known to have side rails for a shredder with fingers extending inward therefrom where the fingers are integral with the side rail.

It is time consuming and expensive to weld the fingers onto the side rail, and it is difficult to weld the fingers within acceptable tolerances for being both parallel to one another, and being spaced the appropriate distance apart from one another. It is also difficult to weld the fingers so that they are within acceptable tolerances for perpendicularity with respect to the side rail. The knives of the shredder are also spaced apart from one another and are parallel to one another. It is desirable to have the fingers as close as possible to the sides of the knives without contacting the knives. In order to obtain a smaller shred size, the knives are made narrower and the spaces between the knives become narrower. The fingers must also become narrower and are located closer together. This can make welding within the required tolerances even more difficult.

With fingers that are integral with the side rails, a relatively large block of material is used, and much of that material is cut away to create the side rail and fingers. That process can also be expensive and time consuming as the material that is cut away is often wasted.

Also, when the fingers are integral with the side rail, different materials cannot be used for the fingers from that used for the side rails. Similarly, when fingers are welded to the side rail, it can be difficult to use different materials because of the difficulty of welding different materials together.

SUMMARY OF THE INVENTION

It is an object of the present invention to provide a side rail for a shredder with fingers partially embedded in a base of the side rail, the base and fingers being made from different materials. More particularly, it is an object of the present invention to provide a side rail having a base with fingers extending inward therefrom where the fingers are made from steel and the base is made from cast aluminum.

A side rail for installation in a shredder comprises fingers being partially embedded in a base. The fingers and the base are made from different materials. The base is shaped to form a sidewall of the shredder with the fingers extending inward from the base, a part of said fingers that is partially embedded in said base, having a plurality of cavities therein, said cavities being filled with said base, the base and fingers being solid.

A method of fabricating a side rail for installation in a shredder uses a side rail comprising fingers that are partially embedded in a base. The fingers and the base are made from different materials, the base being shaped to form a sidewall of the shredder. The method comprises forming a plurality of fingers with a plurality of cavities in a part thereof that is embedded in the base, inserting the fingers partially into a mold, the mold having an interior shape of the base, liquifying a material of the base and pouring the material into the mold to partially embed the fingers in the base with the fingers extending inward from the base and to fill said cavities, the fingers being spaced apart from one another and being parallel to one another, allowing a material of the base to solidify and removing the side rail from the mold.

DETAILED DESCRIPTION OF A PREFERRED EMBODIMENT

Figure 1:
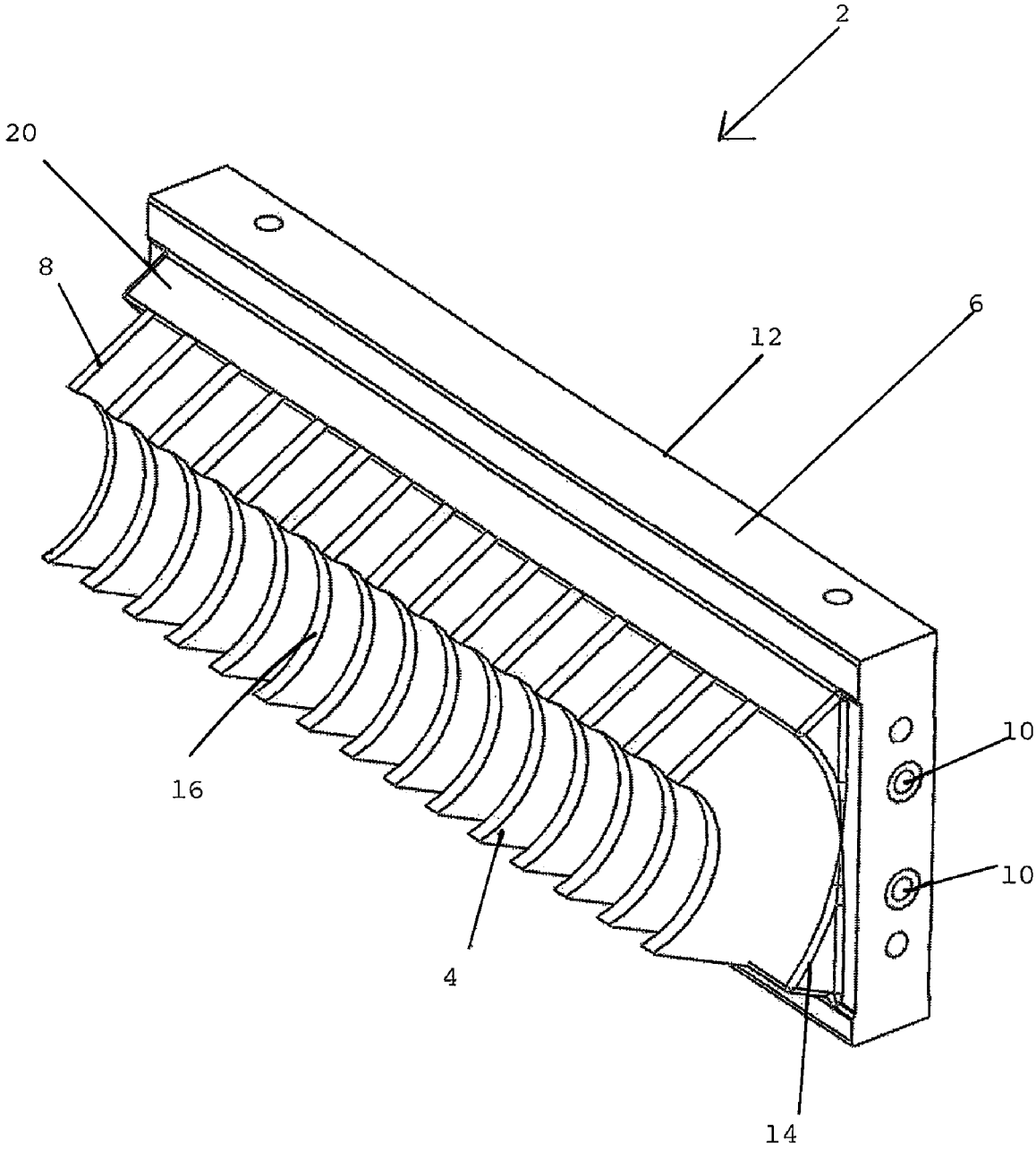
FIG. 1 is a prospective view of a side rail when viewed from an inside.
Figure 2:
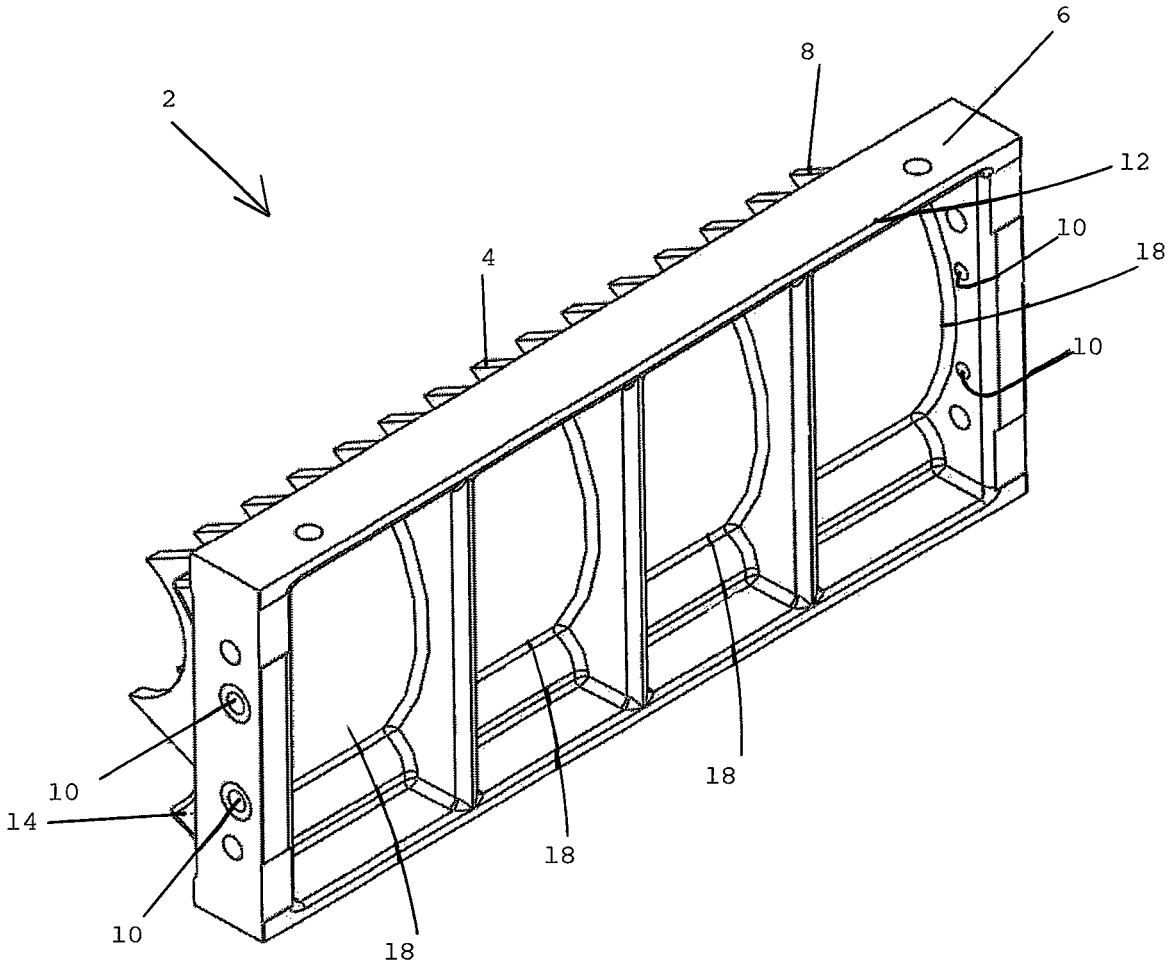
FIG. 2 is a prospective view of a side rail when viewed from an outside.

In FIGS. 1 and 2, a side rail 2 has a plurality of fingers 4 that are spaced apart from one another and are parallel to one another, the fingers being embedded in a base 6 that is shaped to form a sidewall of a shredder (not shown in FIGS. 1 and 2). The fingers 4 can be all the same size, or can be equally spaced from one another, or the size and the spacing can vary. Since the fingers extend between the knives (not shown in FIGS. 1 and 2) of the shredder, the spacing of the fingers will vary as the thickness of the knives varies. While the fingers 4 are equally spaced from one another, one of the fingers 8 is thinner than the remaining fingers because of the space that is available within the shredder (not shown in FIGS. 1 and 2) for the finger 8 to fit into.

The base 6 has female inserts 10 located in each end thereof. The base 6 has a rectangular shape on an outer side 12 thereof, and an arcuate shape on an inner side 14 thereof. The fingers have an inner edge 16 that has a concave shape and the fingers are made from a different material than the material from which the base is formed. The fingers 4 are partially embedded in the base 6. From FIG. 2, it can be seen that the outer side 12 of the base 6 is hollowed out in four rectangularly shaped sections 18, to reduce the weight of the side rail 2. In FIG. 1, a ledge 20 blocks off a space through which paper to be shredded might otherwise pass through the shredder without being shredded.

Figure 3:
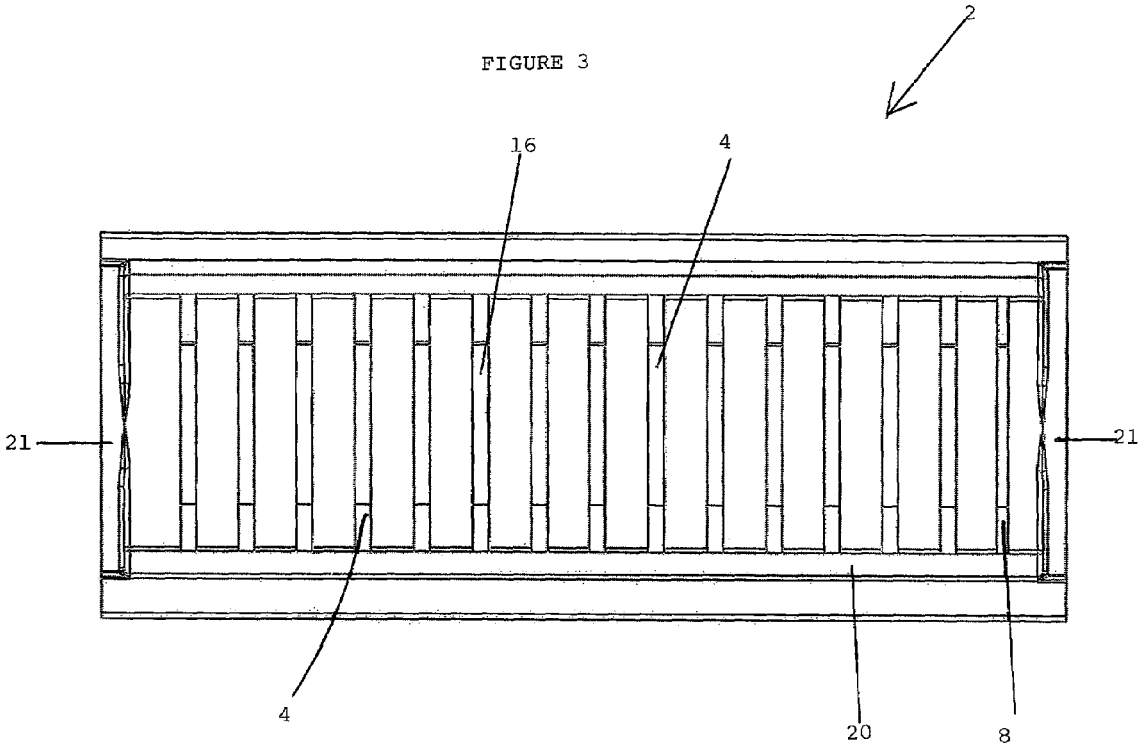
FIG. 3 is a front view of a side rail.
Figure 4:
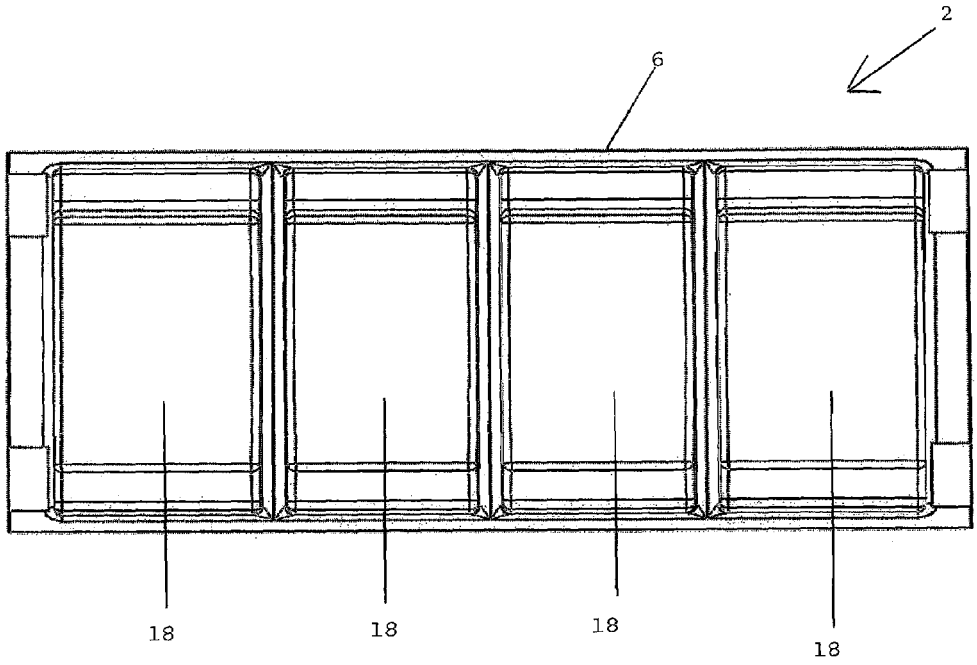
FIG. 4 is a rear view of a side rail.

In FIGS. 3 and 4, the same reference numerals are used as those used in FIGS. 1 and 2 for those components that are identical. In FIG. 3, it can be seen that the fingers 4 and 8 are equally spaced from one another and that the finger 8 is closer to an end wall 21 than the finger 4 at the opposite end of the side rail 2.

Figure 5:
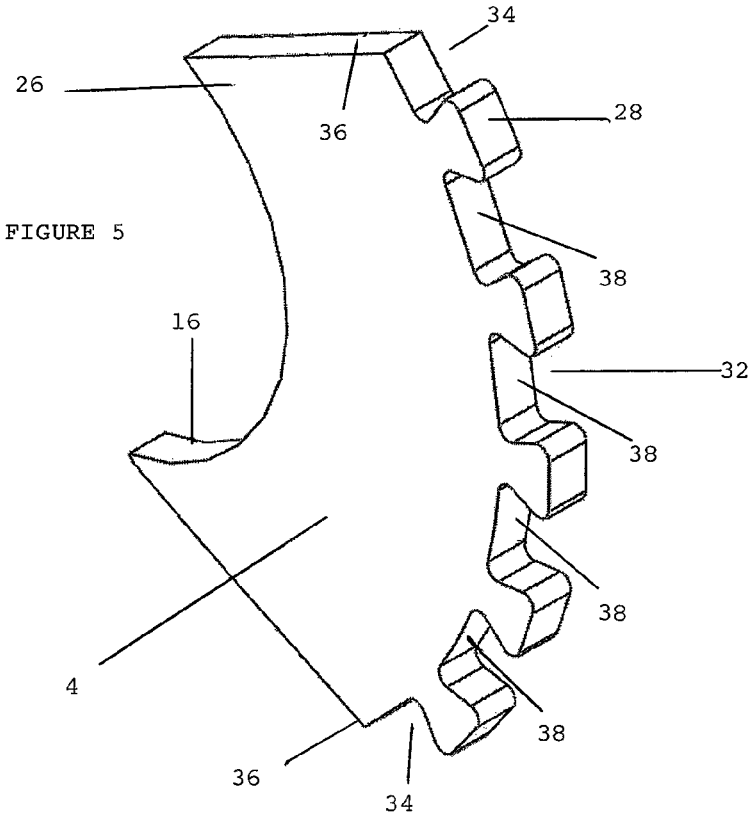
FIG. 5 is a prospective view of one finger.
Figure 6:
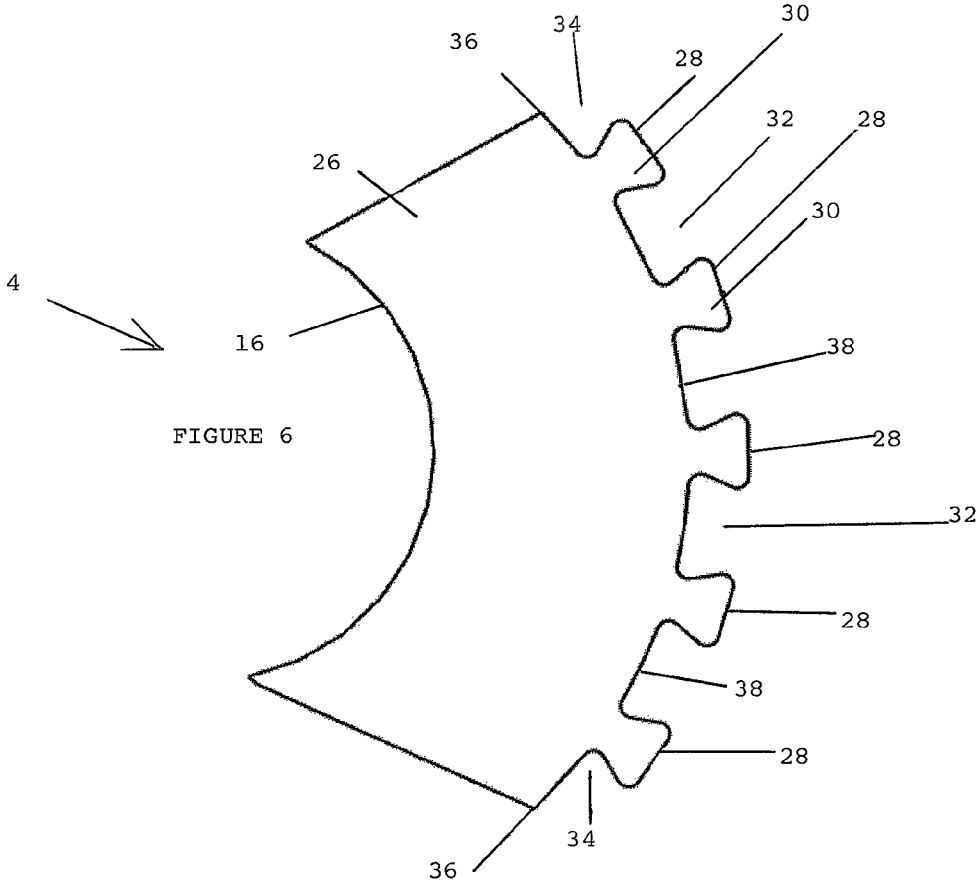
FIG. 6 is a side view of one finger.
Figure 7:
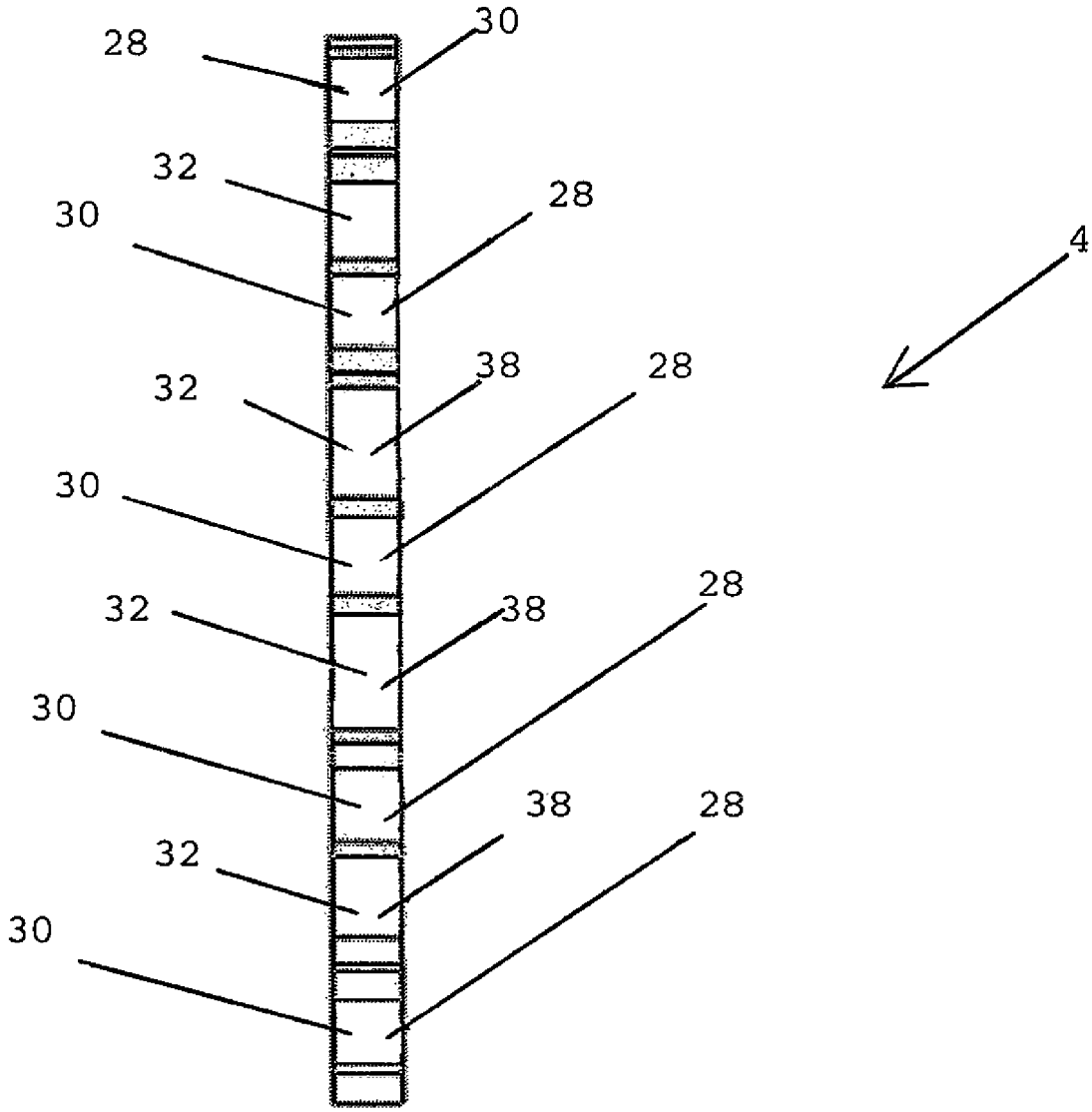
FIG. 7 is a rear view of one finger.

In FIGS. 5, 6, and 7, a finger 4 has a body 26 with the inner edge 16 and an outer end 28. The finger 8 (not shown in FIGS. 5, 6, 7) has the same shape as the finger 4 shown in FIGS. 5 to 7, except that the finger 8 is thinner than the finger 4. The fingers 4, 8 have a plurality of cavities therein that are filled with base (not shown in FIGS. 5, 6 and 7). The cavities can have various shapes and sizes, and preferably, the cavities are indentations. The outer end 28 has a plurality of projections 30 and indentations 32 thereon. The outer end is preferably uneven to strengthen a bond between the metal of said base and the metal of said fingers. The projections 30 and indentations 32 preferably alternate with one another and are shown in FIGS. 5 to 7 as having a dovetail shape. The indentations 32 converge toward the outer end 28. While a dovetail shape is shown for the projections and indentations in FIGS. 5 to 7, other shapes will also be suitable for the projections and indentations as long as the indentations narrow and the projections widen toward the outer end 28. An imaginary line through the projections 30 at the outer end 28 has a convex shape. Indentations 34 located at the upper and lower edges 36 of the finger 4 are approximately half the size of the indentations 32 and do not have a dovetail shape because they do not have a projection on an outer side thereof. The cavities can also be a plurality of openings located near the outer end of the finger. When the cavities are immersed in the base, the base fills the cavities and then is allowed to cool and hardens. An outer edge 38 of the body 26 extends between the projections 30 and beyond projections to the upper and lower edges 36.

Figure 8:
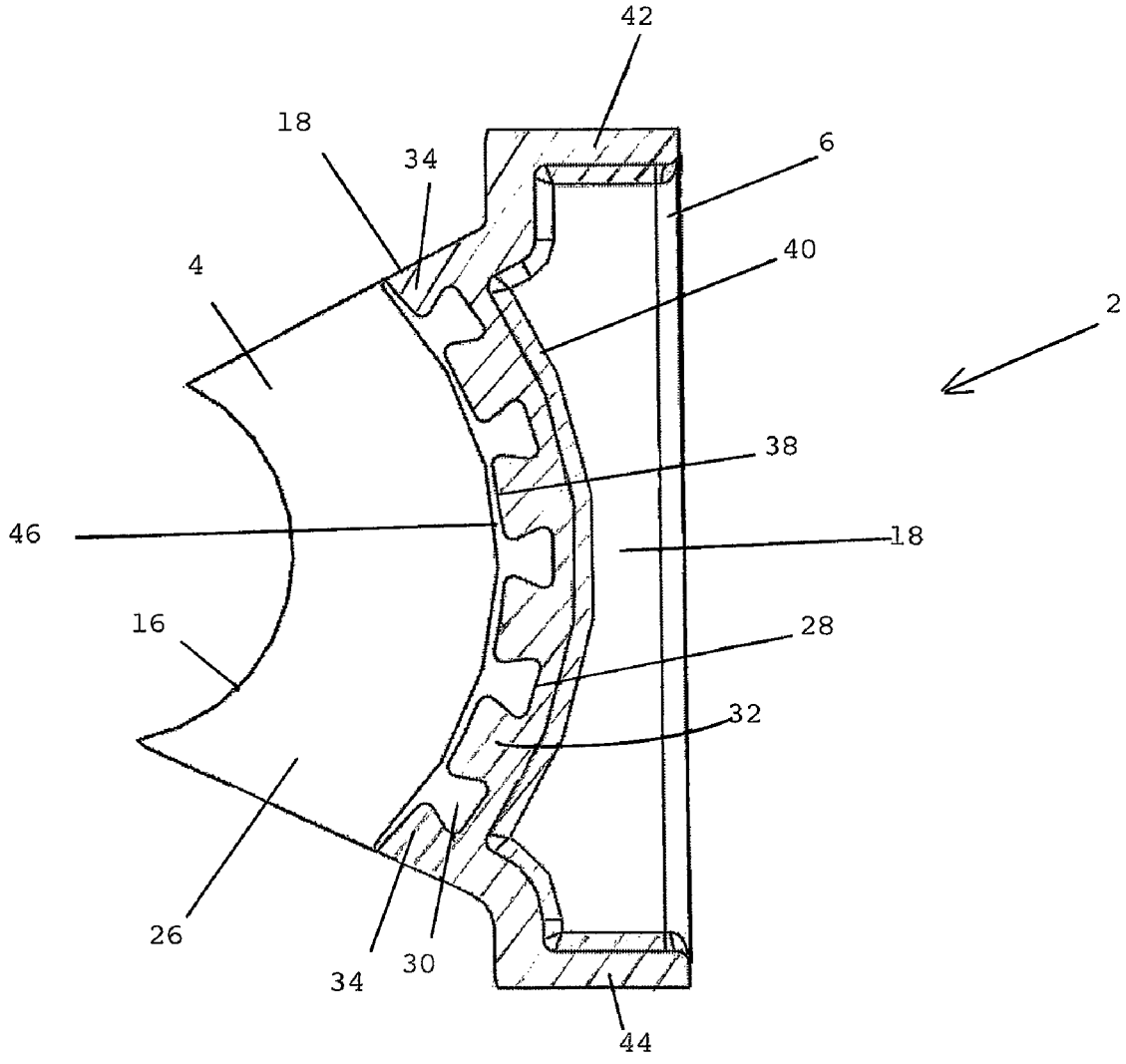
FIG. 8 is a sectional view of a side rail showing one finger embedded in a base.

In FIG. 8, there is shown a sectional end view of the side rail 2. The base 6 has an outer wall 40 with an upper wall 42 and lower wall 44. The base 6 has an inner wall 46 that extends just inside an outer edge 38 of the body 26. The finger 4 is embedded in the base 6 by that portion of the finger 4 that is located within the inner wall 46 and includes all of the projections 30 and the outer edge 38. The indentations 32, 34 are filled by the molten material of the base 6 and converge toward said outer side 12.

The material from which the base 6 is made is liquid at a sufficiently high temperature that becomes solid when it is allowed to cool. The material from which the fingers 4, 8 are made is always different from the material from which the base 6 is made. Preferably, the material from which the base is made is a cast metal, and still more preferably, the fingers are made from steel and the base is made from aluminum. The fingers are preferably laser cut to ensure that all of the fingers have identical dimensions when viewed from the side. It may be desirable to make one or more fingers of a different thickness from the remaining fingers. The fingers are then placed within appropriate openings (not shown) in to a mold (not shown) with that portion of the finger on the outer side of the inner wall 46 extending into the mold. Then, molten metal (preferably aluminum) is poured into the mold and is preferably allowed to flow by gravity to fill the mold and fill each of the indentations adjacent to the projections 30 of the fingers 4. The molten metal is then allowed to cool and the side rail is removed from the mold when the cast metal is sufficiently solid to with stand removal.

The same reference numerals are used in FIG. 8 as those used in FIGS. 1 to 7 for those components that are identical. After removal from the mold, the side rail is heat treated.

More particularly, the aluminum base is heated to 1,000 degrees Fahrenheit and held for four to twelve hours. The side rail is then quenched in water at 150 to 212 degrees Fahrenheit and aged at 310 degrees Fahrenheit for two to five hours. Finally, the base is preferably sandblasted to achieve a smooth, clean finish. The heat treatment process has little effect on the fingers and anneals them slightly.

Figure 9:
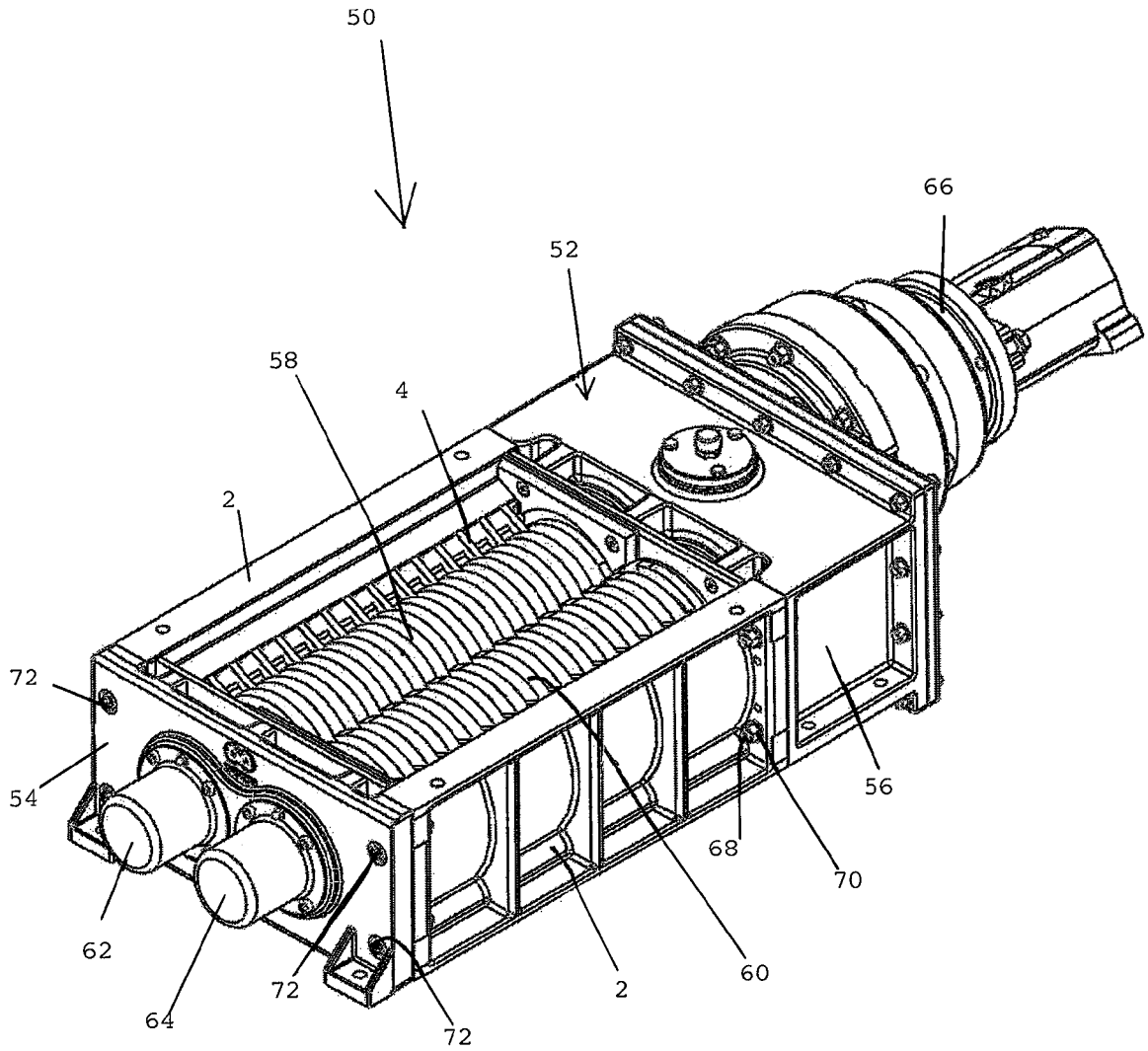
FIG. 9 is a prospective view of a shredder having two side rails in accordance with the present invention.

In FIG. 9, there is shown a shredder 50 that has two side rails 2 installed in accordance with the present invention. The side rails 2 make up part of a housing 52, which has an end plate 54 and a gear box 56. A plurality of knives 58 are spaced apart on a first drive 62 and knives 58, 60 are spaced apart and overlap with one another on a first drive 62 and a second drive 64, respectively. The drives 62, 64 are powered by a drive mechanism 66 connected through the gear box 56 to rotate the drives 62, 64 in opposite directions to shred material that enters the shredder 50. Except for the side rails 2, which include the embedded fingers 4, the shredder 50 is conventional and is not described in further detail except for the connection between the side rails 2 and the remaining parts of the shredder 50.

Bolts 68 and nuts 70 connect the side rail 2 to the gear box 56. Similarly, bolts 72 extend through the end plate 54 and the side rail 2 to connect the end plate to the side rail 2. The nuts for the bolts 72 are not shown in FIG. 9. There are two bolts on each end of each side rail 2.

Figure 10:
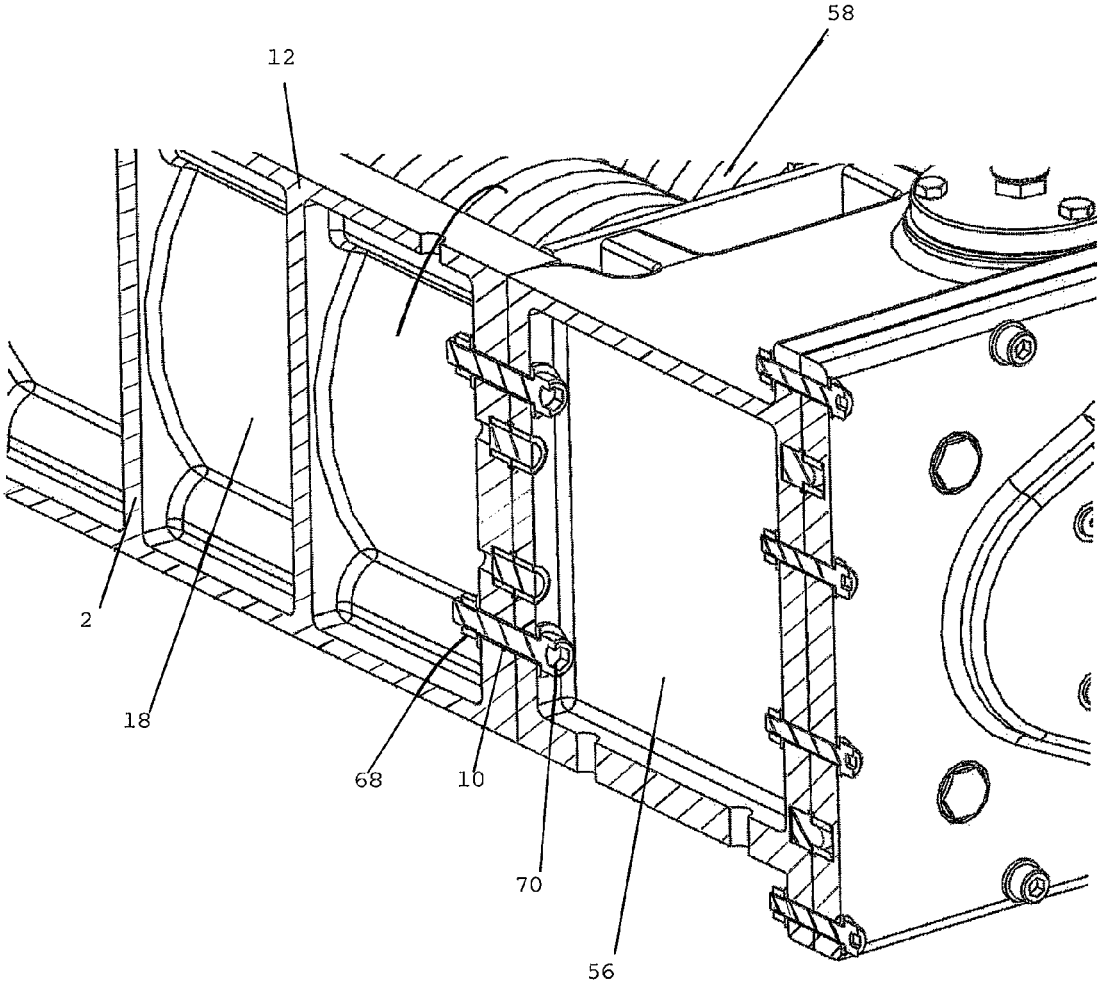
FIG. 10 is a partial sectional prospective view of a side rail being connected to a gear box of a shredder.
Figure 11:
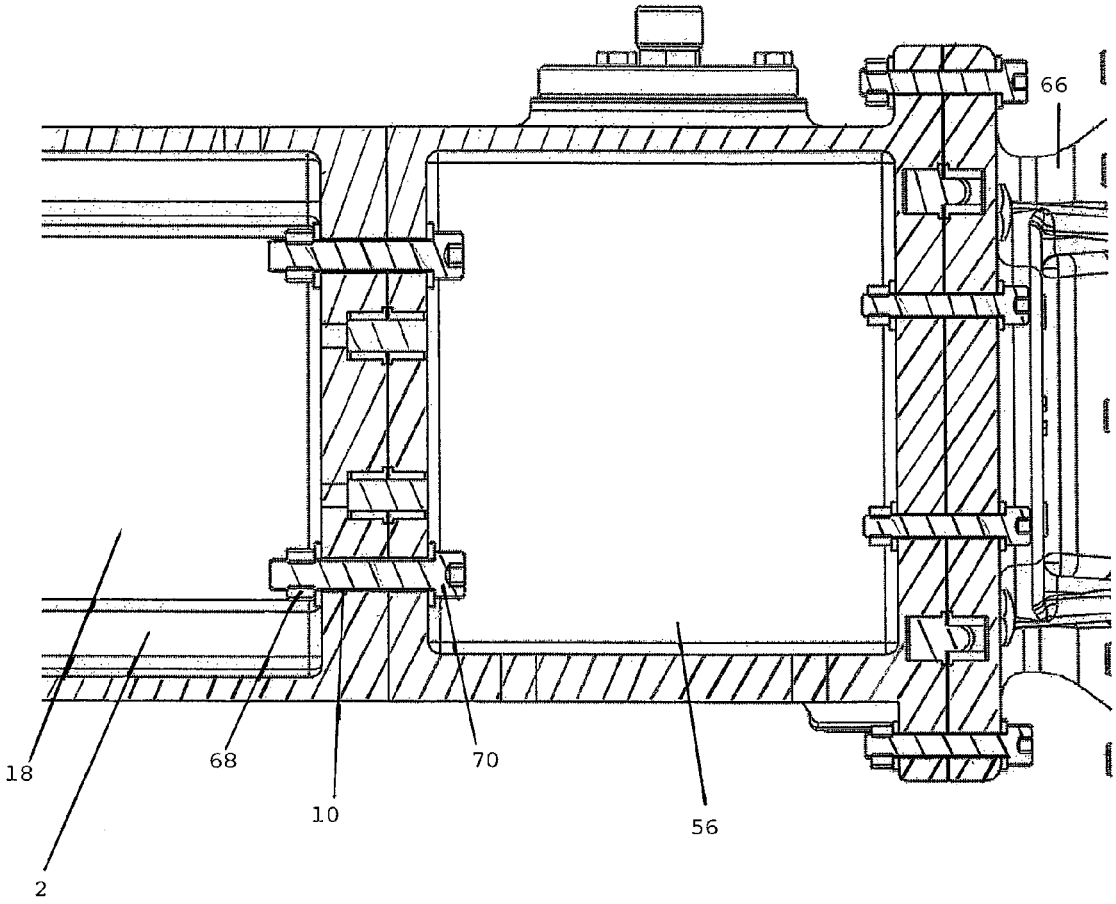
FIG. 11 is a partial sectional side view of the connection between a side rail and a gear box.

In FIGS. 10 and 11, there is shown a partial sectional prospective view, and partial sectional side view of the bolts 70 and nuts 68, extending through inserts 10 in the side rail 2 to connect the side rail 2 to the gear box 56.

Figure 12:
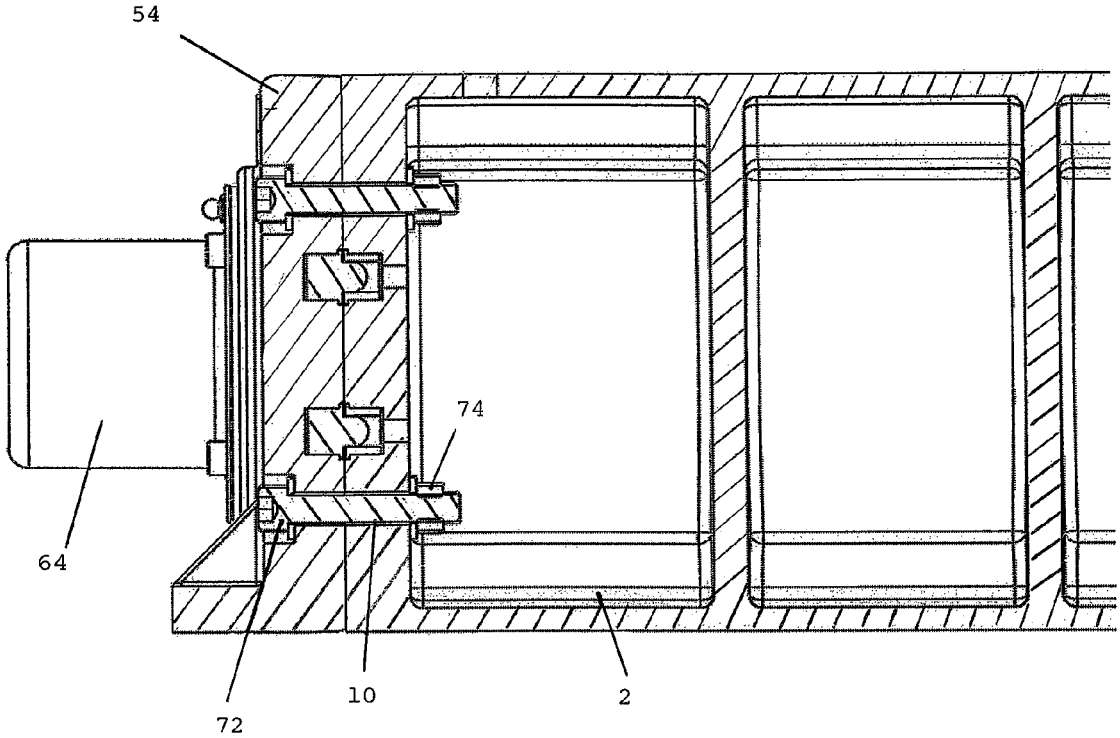
FIG. 12 is a partial sectional side view of the connection between a side rail and an end plate of a shredder.

Similarly, in FIG. 12, there is shown a partial sectional side view of the bolts 72 and nuts 74 connecting the end plate 54 to the side rail 2 through the inserts 10. The same reference numerals are used in FIGS. 10 to 12 as those used in FIG. 9 for those components that are identical.

The advantage of using aluminum for the base is to achieve a light weight side rail. With mobile shredding installations, the shredders are installed in truck bodies to provide onsite shredding. Weight savings achieved in the shredder allow the truck body to be filled with more shredded material without exceeding the weight limit for that particular truck body. It is known that aluminum is not a particularly strong material, yet the bonding between the steel fingers and cast aluminum has been found to be extremely strong. As an example, the thick finger 4 was subjected to 5,004 lbs. of force laterally exerted on the finger 4 approximately one half inch inside the inner edge 16 without damaging the connection between the finger and the aluminum casting. Similarly, the thin finger 8 was subjected to 3,505 lbs. of force exerted laterally against the finger 8 approximately one half inch from the inner edge 16 without damaging the connection between the finger and the aluminum casting. The limiting factor in each test was that the fingers themselves bent in response to the force, but the aluminum did not bend.

I claim:

1. A side rail for installation in a shredder, said side rail comprising fingers being partially embedded in a base, said fingers and said base being made from different materials, said base being shaped to form a sidewall of said shredder and having an inner side and an outer side, with said fingers extending inward from said base, said fingers being in a spaced and parallel relationship to one another, a part of said fingers that is partially embedded in said base having a plurality of cavities therein, said cavities being filled with said base, said base and said fingers being solid.

2. A side rail as claimed in claim 1, wherein the materials are two different metals and said base is formed from east metal.

3. A side rail as claimed in claim 2, wherein said base is bonded to said fingers without adhesive.

4. A side rail as claimed in claim 3, wherein said fingers each have an inner end and an outer end, said outer end being said part of said fingers that is embedded in said base.

5. A side rail as claimed in claim 4, wherein outer end is uneven to strengthen a bond between said metal of said base and said fingers.

6. A side rail as claimed in claim 5, wherein said cavities are indentations and said outer end has a plurality of projections and indentations therein, said indentations converging toward said outer side.

7. A side rail as claimed in claim 6, wherein said projections and indentations alternate with one another.

8. A side rail as claimed in claim 6, wherein said projections and indentations are dovetail shapes.

9. A side rail as claimed in claim 8, wherein said dovetail shapes that are projections are narrower than said dovetail shapes that are indentations.

10. A side rail as claimed in claim 6, wherein said projections of said fingers extend into said cast metal.

11. A side rail as claimed in claim 10, wherein said fingers are made from steel, and said base is made from aluminum.

12. A side rail as claimed in claim 11, wherein said fingers have an inner end with a concave shape, and an imaginary line through an outer edge of said projections at said outer end, having a convex shape.

13. A side rail as claimed in claim 12, wherein said projections on said fingers diverge toward said outer side.

14. A side rail as claimed in claim 11, wherein said base is tempered and said fingers are at least partially tempered when said base is tempered.

15. A side rail as claimed in claim 5, wherein said outer end has a plurality of dovetail shapes formed therein, some of said dovetail shapes being projections and some of said dovetail shapes being indentations that are said cavities, said dovetail shapes that are indentations converging toward said outer side.

16. A side rail for installation in a shredder having a plurality of knives that are spaced apart from and parallel to one another on a drive, said side rail comprising fingers being partially embedded in a base, said fingers and said base being made from different materials, said base being shaped, to form a sidewall of said shredder and having an inner side and an outer side, with said fingers extending inward from said base between adjacent knives of said plurality of knives, there being one finger between two adjacent knives, said fingers being in a spaced and parallel relationship to one another, a part of said fingers that is partially embedded in said base having a plurality of cavities therein, said cavities being filled with said base, said base and said fingers being solid.

* * * * *